United States Patent [19]

Stubben

[11] 3,986,563

[45] Oct. 19, 1976

[54] SUSPENSION AND CONTROL LINKAGE FOR A GRADE BLADE SUPPORT FRAME

[75] Inventor: David William Stubben, Dubuque, Iowa

[73] Assignee: Deere & Company, Moline, Ill.

[22] Filed: May 1, 1975

[21] Appl. No.: 573,485

[52] U.S. Cl. ..... 172/793; 172/666

[51] Int. Cl.[2] ..... E02F 3/76

[58] Field of Search ..... 172/793, 792, 791, 795, 172/796, 797, 666

[56] References Cited

UNITED STATES PATENTS

| | | | |
|---|---|---|---|
| 3,421,589 | 1/1969 | Rivinius | 172/793 X |
| 3,455,400 | 7/1969 | Hanser et al. | 172/793 |
| 3,739,861 | 6/1973 | Johnson et al. | 172/793 |

*Primary Examiner*—George J. Marlo

[57] ABSTRACT

A motor grader includes a blade support frame in the form of a drawbar located beneath and having its forward end universally pivotally connected to an arched beam forming a fore-and-aft extending main frame section of the grader. The drawbar is further connected to the arched beam through means of a suspension and control linkage including a pair of bell cranks pivotally connected at opposite sides of the beam for movement about respective fore-and-aft axes. A transverse bar extends beneath the beam and has opposite ends thereof respectively pivotally connected to respective first arms of the bell cranks. A pair of two-way hydraulic lift actuators respectively have first ends pivotally connected to respective second arms of the bell crank and respectively have second ends pivotally connected to opposite side of the drawbar. A side-shift actuator extends beneath the beams and has its opposite ends respectively pivotally connected to one side of the drawbar and the bell crank which is the most remote therefrom. A hydraulically operable locking pin is fixed to the beam adjacent the transverse bar and the latter is provided along its length with a plurality of holes for selective reception of the locking pin to fix the blade support frame in a desired position. For the same purpose, further holes are located in the bell cranks. Provision is made for pressure engagement and disengagement of the locking pin.

3 Claims, 5 Drawing Figures

SUSPENSION AND CONTROL LINKAGE FOR A GRADE BLADE SUPPORT FRAME

BACKGROUND OF THE INVENTION

The present invention relates to a suspension and control linkage for a blade support frame of a motor grader and more specifically relates to a suspension and control linkage of the type disclosed in U.S. Pat. No. 3,739,861 granted to Johnson et al on June 19, 1973.

The suspension and control linkage disclosed in the abovementioned Johnson et al patent includes a pair of bell cranks pivotally mounted on opposite sides of the main fore-and-aft extending arched frame of the motor grader for movement about respective fore-and-aft extending axes. A crossbar extends beneath the frame and has its opposite ends respectively pivotally connected to first arms of the bell cranks. A pair of blade lift actuators are respectively pivotally connected between the blade support frame and respective second arms of the bell cranks and a side shift actuator is provided between the crossbar and the blade support frame. The crossbar is provided with a plurality of holes along its length and a normally spring engaged hydraulically releasable locking pin is mounted on the frame and operative to selectively enter one of the holes to fix the blade support frame in a desired position.

The patented linkage is not fashioned as well as it might be for increased visibility and to the end of permitting a large amount of bell crank rotation in order that the blade may be operated to positions giving the machine more versatility.

SUMMARY OF THE INVENTION

According to the present invention there is provided a novel suspension and control linkage for the blade support frame of a motor grader.

A broad object of the invention is to provide a suspension and control linkage; as mentioned in the preceding paragraph, which is constructed so as to maximize visibility.

A more specific object is to provide a suspension and control linkage wherein a pair of bell cranks are pivotally mounted on opposite sides of a fore-and-aft extending arched frame of the motor grader and are interconnected by a crossbar located beneath the frame, the bell cranks and the crossbar all having holes therein for selective reception of a locking pin for locking the suspension and control linkage in a desired position.

Another object of the invention is to provide a pair of bell cranks as described in the preceding paragraph which are shaped such that the side shift cylinder clears the frame when the suspension and control linkage is in one or the other of extreme positions with the hole in one or the other of the bell cranks being respectively positioned for receiving the locking pin.

Still another object of the invention is to provide means for indicating to the operator the position of the linkage relative to the locking pin.

These and other objects will become apparent from reading the following description in conjunction with the appended drawings.

DESCRIPTION OF THE PREFERRED EMBODIMENT

Figure 1:
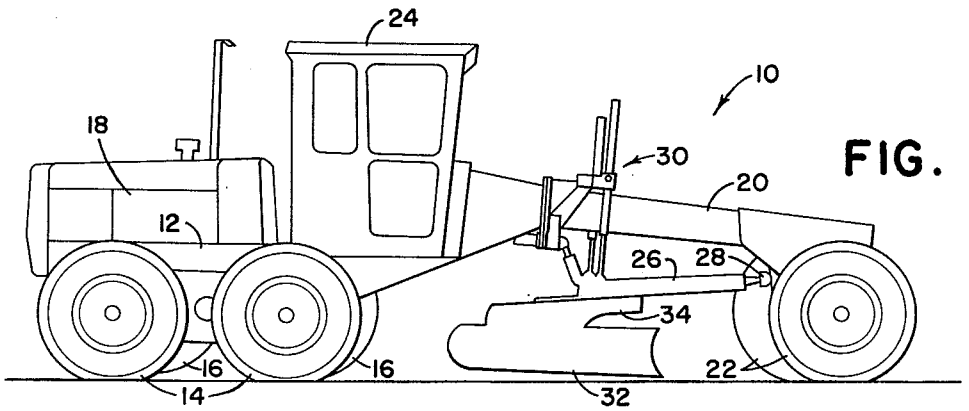
FIG. 1 is a right side perspective view of a motor grader of the type with which the suspension and control linkage of the present invention is particularly adapted for use.

Referring now to FIG. 1, therein is shown a motor grader indicated in its entirety by the reference numeral 10. The grader 10 includes a rear frame section 12 supported on right and left sets of bogie wheels 14 and 16, respectively. A prime mover 18 is mounted on the frame section 12.

Pivotally connected, in a conventional manner, not shown, to the rear frame section 12 for articulative movement relative thereto, about a vertical axis, is a front frame section 20 in the form of an elongate beam of rectangular cross section and having its forward end supported on a pair of front wheels 22. An operator cab 24 is mounted on a rear portion of the front frame section 20.

A blade support frame 26 is positioned beneath the front frame section 20 and has its forward end universally connected, as at 28, to the frame section 20 at a location between the front wheels 22. The rear end of the frame 26 is connected to the frame section 20 through means of a suspension and control linkage indicated in its entirety by the reference numeral 30. A grader blade 32 is connected to the frame 26 through means of a grader circle 34 which is rotatably connected to the frame 28 in a conventional manner (not shown).

Figure 3:
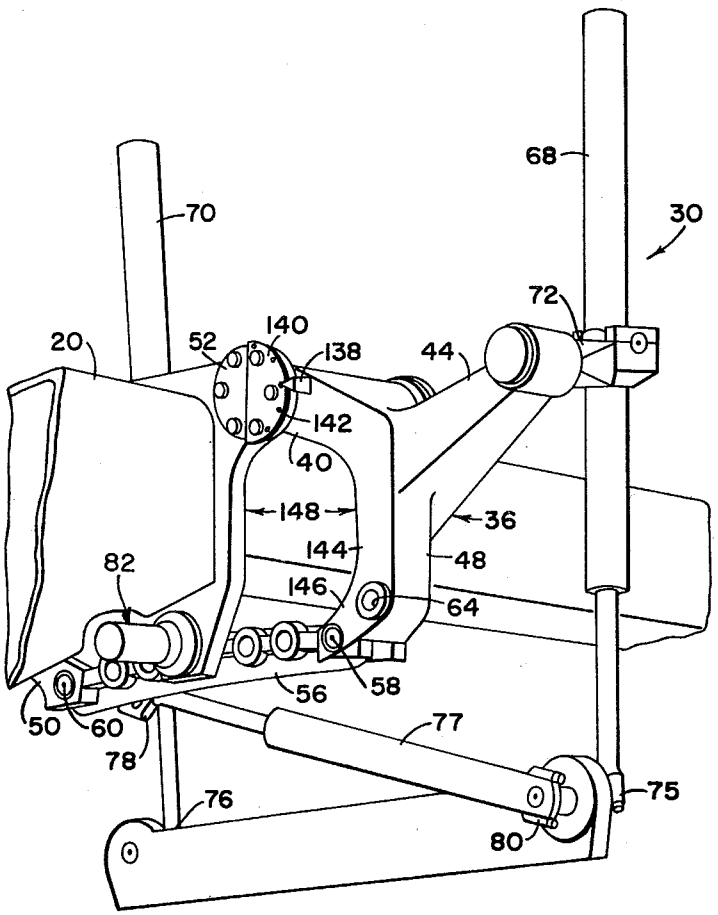
FIG. 3 is a right rear perspective view of the suspension and control linkage of the present invention.
Figure 2:
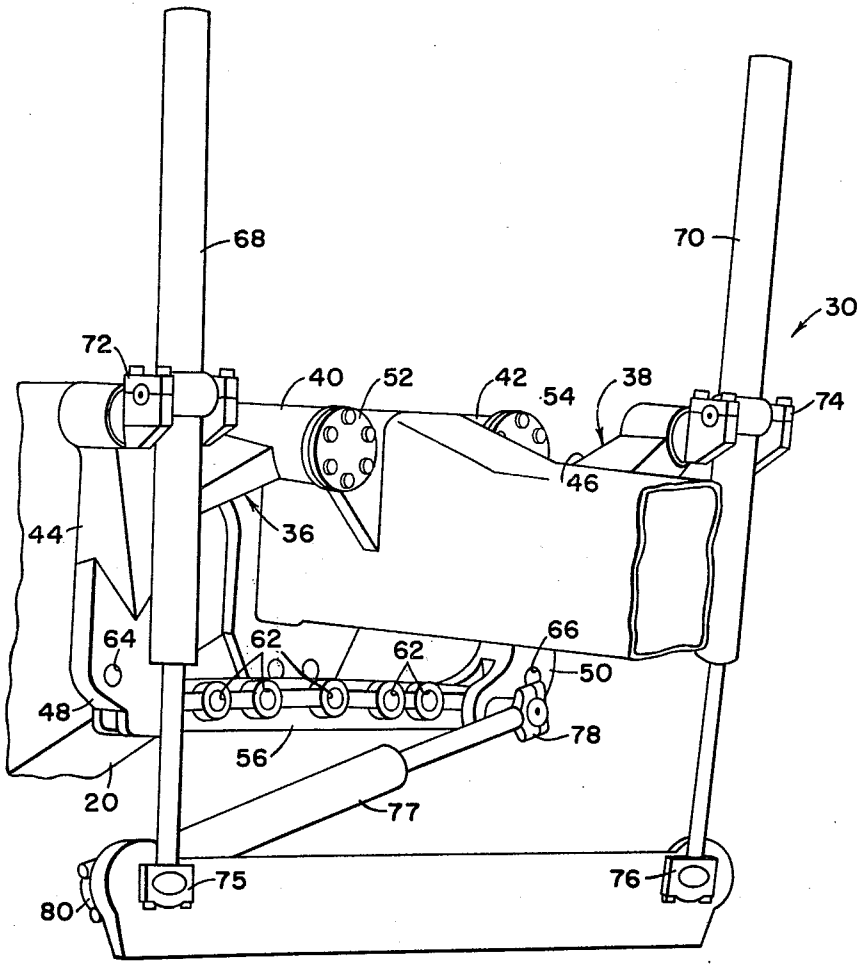
FIG. 2 is a right front perspective view of the suspension and control linkage of the present invention.

As can best be seen in FIGS. 2 and 3, the linkage 30 includes angularly adjustable right and left bell cranks 36 and 38 arranged at the opposite sides of the front frame section 20 and being configured so as to be mirror images of each other. The bell cranks 36 and 38, when in intermediate positions as illustrated in FIGS. 2 and 3, are generally Y-shaped as viewed in the direction of travel of the grader 10. Specifically, the bell cranks 36 and 38 respectively include inner arms 40 and 42, outer arms 44 and 46 and lower arms 48 and 50. The inner arms 40 and 42 are respectively pivotally connected, as at 52 and 54, to upper locations of the opposite sides of the frame section 20 for movement about respective fore-and-aft axes defined by the connections 52 and 54. A crossbar or connection link 56 is transversely positioned below the frame section 20 and has its right and left ends respectively pivotally connected to the lower ends of the lower arms 48 and 50 by fore-and-aft extending pivot pins 58 and 60. Thus, it will be appreciated that movement of either of the bell cranks 36 and 38 will effect like movement of the other through means of the crossbar 56. Provided along the length of the crossbar 56 are five fore-and-aft arranged locking pin receptacles or holes 62 adapted for receiving a locking pin, to be presently described, for fixing the linkage made up of the bell cranks 36 and 38 and the crossbar 56 in a desired disposition. Additional locking pin receptacles or holes 64 and 66 are respectively provided in the lower arms 48 and 50 of the bell cranks 36 and 38.

For the purpose of adjusting the blade support frame 26 about the universal connection 28, there are provided right and left extensible and retractable hydraulic lift actuators 68 and 70, respectively, having cylinder portions swivelly connected to the outer ends of the outer arms 44 and 46 by swivel connections 72 and 74 and having rod portions universally connected to opposite sides of the rear of the frame 26 by universal connections 75 and 76. Further, an extensible and retractable hydraulic side-shift actuator 77 is connected between the lower arms 50 of the left bell crank 38 and the right side of the frame 28 with its rod end universally connected as at 78 by means including the pivot pin 60 and with its cylinder end universally connected, as at 80.

Provided for cooperating with the locking pin holes 62 in the crossbar 56 and the holes 64 and 66, respectively in the bell cranks 36 and 38, for locking the linkage made up of the cranks 36 and 38 and the crossbar 56 in a desired position, is a locking pin means (FIG. 4) indicated in its entirety by the reference numeral 82. The locking pin means 82 includes a fore-and-aft extending cylinder 84 fixed to the underside of the front frame section 20, at a central location just rearwardly of a portion of the path traced by end portions of each of the bell cranks 36 and 38 and by the crossbar 56; and the holes 62, 64 and 66 being so located that they are moved into axial alignment with the cylinder 84 during movement of the bell cranks 36 and 38, and the crossbar 56. The cylinder 84 has an open front end 86 and a closed rear end 88 and is divided into front and rear sections 90 and 92, respectively, by a partition 94. Mounted in the cylinder 84 is a locking pin 96 including a shank 98 projecting through and slidably supported in the partition 94 and a tapered forward end portion 100 stepped up in diameter from the shank 98 and located in the front cylinder section 90. An annular piston 102 is secured on the shank 98 adjacent the rear end of the latter.

Figure 5:
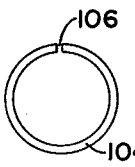
FIG. 5 shows a sealing ring used with the locking pin.

The piston 102 includes a sealing ring 104 slidably engaged with the rear cylinder section 92, and split so as to define a gap 106 between opposite ends thereof (FIG. 5), for establishing a restricted fluid passage for placing the opposite faces of the piston 102 in fluid communication with each other for a purpose to be presently described.

It is here to be noted that due to the presence of the shank 98 in front of the piston 102, a differential area situation obtains whereby the presence of equal fluid pressure in the rear cylinder section 92 at the opposite sides of the piston 102 will result in an unbalanced pressure force acting on the rear end of the pin 96.

For the purpose of delivering pressure fluid to the rear cylinder section 92, a pump 108 is connected in a supply line means 110 extending between a reservoir 112 and an inlet port 114 located in the cylinder 84 so as to admit fluid to the rear cylinder section 92 at a location forwardly of the piston 102. For the purpose of selectively quickly reducing the fluid pressure in the cylinder section 92 rearwardly of the piston 102, there is provided a dump valve 116 located in a return line means 118 having one end connected to the reservoir 112, and another end connected to an outlet port 120, located in the cylinder section 92 rearwardly of the piston 102. The dump valve 116 includes a housing provided with a vertical bore 122 having a lower end defining an inlet port 124 connected in constant fluid communication with the outlet port 120, and having an intermediate location intersected by an outlet port 126 connected in constant fluid communication with the reservoir 112. A check ball 128 is located in the bore 122 between the inlet port 124 and a downwardly facing valve seat 130 defined by the bore 122 at a location between the inlet port 124 and the outlet port 126. The check ball 128 is normally held against the valve seat 130 by fluid pressure so as to prevent fluid flow through the dump valve 116. Provided for the purpose of selectively unseating the check ball 128 is a manually operable plunger 132, reciprocably mounted in an upper enlarged portion of the bore 122, and a pin 134 positioned between the lower end of the plunger 132 and the check ball 128.

Figure 4:
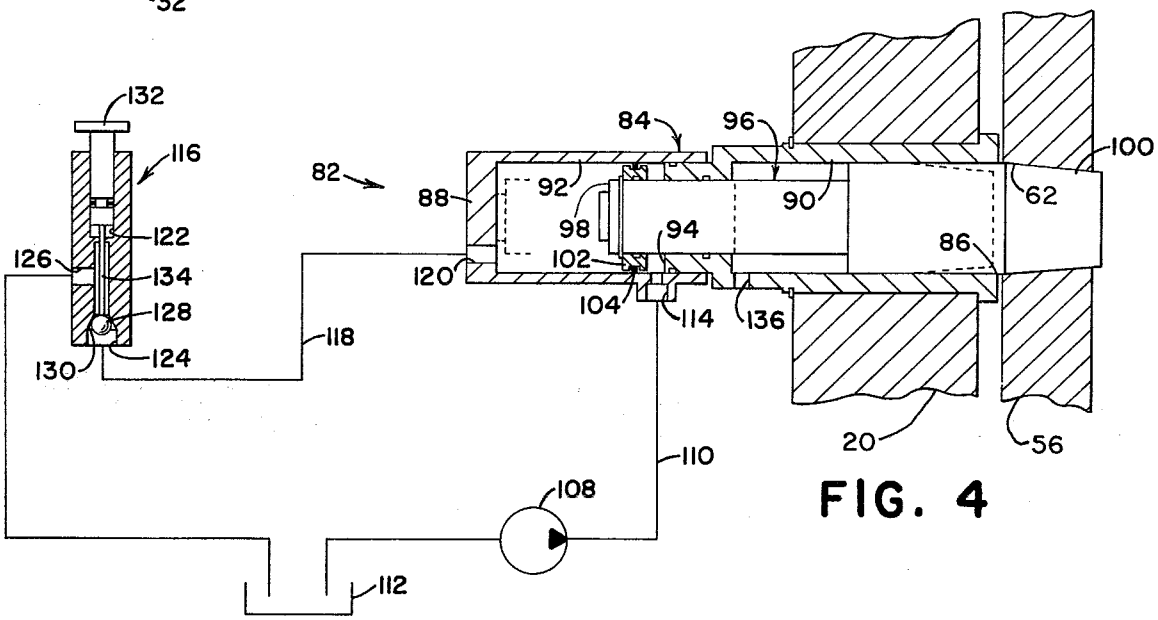
FIG. 4 is schematic of the hydraulic control system for hydraulical operation of the locking pin.

As illustrated in FIG. 4, the locking pin 96 is shown in solid lines in a forwardly shifted locking position, wherein its forward tapered end portion 100 is received in one of the holes 62 provided in the crossbar 56, and is shown in broken lines in a retracted, released position wherein the forward tapered portion 100 is withdrawn from one of the holes 62 provided in the crossbar 56 and is disposed completely within the forward cylinder section 90. It is here noted that to prevent an air lock from developing in the forward cylinder section 90 during movement of the pin portion 100, a bleed hole 136 is provided.

Associated with the right bell crank 36 is an indicator means for apprising the operator of when one of the holes 62, 64 or 66 is aligned for reception of the locking pin 96. Specifically, the indicator means includes a pointer 138 fixed to the rear side of the bell crank 36 adjacent the pivot connection 52 of the inner arm 40 with the frame section 20. Spaced angularly about the fore-and-aft pivot axis defined by the connection 52 and located on a rearward surface of a semicircular plate 140 fixed to the frame section 20 and forming a part of the connection 52, are a plurality of marks or indicia 142 corresponding to the holes 62, 64 and 66 and located such that when the pointer 138 is positioned thereabove the pin 96 is aligned for reception in a corresponding one of the holes 62, 64 and 66.

It is here to be noted that the bell cranks 36 and 38 are shaped so as not to overly restrict the operator's view of the area in the vicinity of the front wheels 22 and of the working area of the blade 32 of the grader 10. Specifically, when the locking pin 96 is engaged with the middle one of the holes 62 in the crossbar 56, as illustrated in FIGS. 2 and 3, the inner arm 40 of the right bell crank 36 extends outwardly and downwardly from the frame section 20, at an angle in the neighborhood of 25° to 30° from the horizontal, and joins a substantially vertical section 144 of the lower arm 48, the latter having a lower end section 146 which is angled downwardly and inwardly from the vertical section 144 at an angle in the neighborhood of 25° to 30° from the horizontal. Thus, the inner and lower arms 40 and 48 cooperate to form a generally reverse C-shape that results in a relatively large "vision window" 148 (FIG. 3) being at the right side of the frame section 20. The vision window 148 will, of course, respectively increase and decrease in size as the bell crank 36 moves counter-clockwise and clockwise from its illustrated intermediate position. However, a corresponding vision window (not shown) defined by the left bell crank 38 will respectively increase and decrease in size as the vision window 148 decreases and increases in size thereby insuring that the operator has adequate visual contact with the area in the vicinity of the front wheels 22. Further, it is to be noted that when the right bell crank 36 is in its extreme clockwise position, as viewed in FIG. 3, the hole 64 in the lower arm 48 will be disposed in alignment with the pin 96 and the inner and lower arms 40 and 48 will be spaced from and will generally conform to the outline of the frame section 20.

The operation of the suspension and control linkage 30 is as follows. Assuming the linkage comprised by the right and left bell cranks 36 and 38 and the crossbar 56 to be in the intermediate position shown in FIGS. 2 and 3 and the locking pin means 82 to be in the condition illustrated in FIG. 4, the pin 96 will be pressure-urged into the middle one of the five holes 62 located in the crossbar 56. It is clear then that the blade support frame 26 may be manipulated to desired positions by selective actuation of the lift actuators 68 and 70 and the side shift actuator 77.

The linkage comprising the bell cranks 36 and 38 and the crossbar 56 may be adjusted to either side of its illustrated intermediate position in order that the blade 32 may be disposed at positions not possible when the linkage is positioned as shown. For example, the linkage may be adjusted to an extreme rightward position by first resting the blade 32 on the ground by operation of the lift actuators 68 and 70. The locking pin 96 is then caused to become disengaged from the middle hole 62 of the cross-bar 56 by depressing the plunger 132 of the dump valve 116 so as to unseat the check ball 128 and permit fluid to flow from the outlet port 120 of the cylinder section 92, through the dump valve 116 and to the reservoir 112. When this flow takes place the pressure to the rear of the piston 102 quickly drops since the flow of the fluid supplied by the pump 108 is greater than the flow permitted by the gap 106 and the pressure acting on the front of the piston 102 acts to shift the latter rearwardly resulting in the pin 96 being retracted to its released position indicated in dashed lines in FIG. 4.

Once the pin 96 is retracted, the right and left lift cylinders 68 and 70 are respectively actuated to extend and retract so as to cause the bell cranks 36 and 38, as viewed in FIG. 3, to respectively be swung counterclockwise and clockwise from their illustrated positions. The operator will maintain the dump valve 116 in its open position until the right bell crank 36 has moved far enough to dispose the pointer 138 above the end one of the marks 142. He then will release the plunger 132 to permit the check ball 128 to return to its normal position wherein it is seated against the valve seat 130. The pressure at the opposite sides of the piston 102 will then equalize by fluid flow through the gap 106 resulting in the pin 96 being pressure-urged to its extended locking position with the tapered end portion 100 thereof inserted in the hole 64 in the right bell crank 36. With the locking pin 96 so located, the blade support frame 26 may again be manipulated to desired orientations by selective actuation of the lift actuators 68 and 70 and the side shift actuator 77.

Thus, it will be appreciated that the linkage comprised of the bell crank 36 and 38 and the crossbar 56 may be moved to any selected position wherein one of the holes 62, 64 or 66 is in alignment with the pin 96 by first resting the blade 32 on the ground, then retracting the pin 96 to its released position and then by actuating the lift actuators 68 and 70 in such a way as to cause the linkage to be shifted to its new position.

I claim:

1. In a motor grader of a type including a longitudinally extending main frame having front and rear wheel-supported ends, a drawbar having a forward end universally connected to a forward underside portion of the main frame, a blade carrying moldboard secured to the distal end of the drawbar, right and left bell cranks pivotally supported at portions intermediate upper and lower ends thereof respectively to right and left side portions of the main frame, located generally above the distal end of the drawbar, for swinging about respective parallel, longitudinally extending axes; a cross link extending below the main frame and having opposite ends respectively pivotally connected to the lower ends of the right and left bell cranks, right and left hydraulic lift actuators respectively connected between the upper ends of the right and left crank arms and right and left side portions of the drawbar; a hydraulic side shift actuator connected between the cross link and one side of the drawbar, a longitudinally operable locking pin fixed to the main frame at a central location at the underside thereof and so as to be adjacent a path of movement traced by the cross link when the crank arms are caused to be swung about their respective pivot axes, and a plurality of longitudinally extending apertures located in the cross link for receiving said locking pin, the improvement comprising: at least one further longitudinally extending aperture being located in each of said right and left bell cranks; and said right and left bell cranks being configured such that said further longitudinally extending apertures are respectively movable to positions for receiving said locking pin.

2. The motor grader defined in claim 1 wherein the side shift actuator is connected to the cross link at one of the connections of the latter with the right and left bell cranks.

3. The motor grader defined in claim 1 and further including linkage position indicating means including a first member fixed to the main frame in the vicinity of one of said bell cranks, and having indicia thereon indicating positions of said last named bell crank corresponding to positions whereat the locking pin is received in one of said longitudinal apertures; a pointer member movable with said last named bell crank and associated with said first member so as to point to the appropriate indicia for indicating the position of the linkage comprising the right and left bell cranks, and said cross links.

* * * * *